US007522030B2

(12) United States Patent
Kobayasi

(10) Patent No.: US 7,522,030 B2
(45) Date of Patent: Apr. 21, 2009

(54) STARTER RELAY

(75) Inventor: Masahide Kobayasi, Saitama-ken (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 96 days.

(21) Appl. No.: 11/451,863

(22) Filed: Jun. 13, 2006

(65) Prior Publication Data

US 2007/0001801 A1 Jan. 4, 2007

(30) Foreign Application Priority Data

Jun. 29, 2005 (JP) ..... 2005-189316

(51) Int. Cl.
*H01C 7/10* (2006.01)

(52) U.S. Cl. ..... 338/22 R; 338/226

(58) Field of Classification Search ..... 338/22 R, 338/220, 226, 232, 315, 322, 20, 21, 25
See application file for complete search history.

(56) References Cited

U.S. PATENT DOCUMENTS 3,842,188 A 10/1974 Petersen ..... 174/52 R
3,955,170 A 5/1976 Geishecker ..... 338/22 SD
4,037,316 A 7/1977 Stoll ..... 29/622
4,327,481 A 5/1982 Woods ..... 29/619
5,606,302 A * 2/1997 Ichida ..... 338/22 R
5,945,903 A * 8/1999 Reddy et al. ..... 337/197
5,963,125 A * 10/1999 Mochida et al. ..... 338/234
6,025,771 A * 2/2000 Kobayashi et al. ..... 338/22 R
6,617,955 B2 * 9/2003 Tanaka et al. ..... 338/22 R

FOREIGN PATENT DOCUMENTS

JP 05-015178 1/1993
JP 08-266076 10/1996

* cited by examiner

*Primary Examiner*—K. Richard Lee
(74) *Attorney, Agent, or Firm*—Weingarten, Schurgin, Gagnebin & Levoici LLP

(57) ABSTRACT

A starter relay comprises a container composed of an electrical insulating hard resin, a resistor having a positive resistance temperature coefficient and housed in the container, and contact springs of feeding devices having conduction and resilience configured to press the resistor to establish connection with the resistor. The contact springs each include a body, two arms extending from the body, and spaced press-fit contacts extending from the arms to press the resistor. The press-fit contacts of one of the contact springs and the press-fit contacts of the other are arranged in crossed directions. Thus, a broken fragment of the resistor is not pinched between the contact springs even when the resistor pinched is broken.

2 Claims, 4 Drawing Sheets

STARTER RELAY

This application claims priority to Japanese application No. 2005-189316 filed Jun. 29, 2005.

BACKGROUND OF THE INVENTION

1. Field of the Invention

The present invention relates to a starter relay for use in a single-phase induction motor and so forth.

2. Description of the Related Art

A starter relay of this type may comprise a resistor 1 having a positive resistance temperature coefficient (PTC), which is pinched between a pair of contact springs 5, 6 in the form of separated V-shapes and housed in a container 2 of an electric insulator as shown in FIG. 4. This is well known as a starter relay 100X for a single-phase induction motor to drive a compressor incorporated in a household refrigerator (see Patent Document 1: JP-A 5-15178).

The resistor 1 may be made of barium titanate ceramics (Curie point: 130° C.), which has an electrical resistance that sharply increases when heated up to a certain temperature or higher.

The starter relay 100X is disposed as connected to an auxiliary winding of the single-phase induction motor. On starting of the single-phase induction motor, the temperature at the resistor 1 is low. Accordingly, the resistor 1 has a low electric resistance so that large starting current flows in the auxiliary winding to begin starting. The current flowing in the resistor 1 elevates the temperature by self-heating, which increases the electrical resistance, which lowers the current flowing in the auxiliary winding.

A starter relay 100Y having a structure shown in FIG. 5 is also well known (see Patent Document 2: JP-A 8-266076). In the starter relay 100X shown in FIG. 4, the resistor 1 is inserted between the contact springs 5, 6 while expanding the space between the contact springs 5, 6. In this case, the contact springs 5, 6 apply a pinching force against both sides of the resistor 1 from the time of insert. The force may damage the surface of the resistor 1 and cause a contact failure between the resistor 1 and the contact springs 5, 6 because of deflected opening of the contact springs 5, 6. In the starter relay 100Y, to the contrary, when a main container 2A and a lid container 2B are not integrated, a pair of contact springs 5, 6 has a small pinching force against the resistor 1. (Therefore, the resistor 1 can be installed between the contact springs 5, 6 with an easy work). On the other hand, when the main container 2A and the lid container 2B are integrated and protrusions 2C are fitted into required portions, the pair of contact springs 5, 6 applies a large pinching force for press-pinching the resistor 1. This starter relay 100Y is thus configured to solve the above problem associated with the starter relay 100X.

The starter relay 100X and the starter relay 100Y are structured such that the pair of contact springs 5, 6 pinching the resistor 1 from both sides can press and pinch surface-symmetrical sites of the resistor 1 from both sides. Accordingly, when the resistor 1 is broken, a broken fragment of the resistor is pinched between the pair of contact springs 5, 6. In this case, that portion radiates heat and elevates the temperature when power is supplied from terminals 7, 8, possibly resulting in production of smoke as a problem.

SUMMARY OF THE INVENTION

Therefore, in an intended structure, any broken fragment can not be pinched between a pair of contact springs when a contained resistor is broken, producing no smoke even when energized.

In one major aspect the present invention provides a starter relay, which comprises a resistor having a positive resistance temperature coefficient; a pair of conductive pinchers having conduction and resilience and configured to press a pair of opposite surfaces of the resistor and pinch the resistor to establish connection with the resistor; and a container composed of an electrical insulator to house the resistor and the pair of conductive pinchers therein. The conductive pinchers each include a body, arms extending from the body, and press-fit contacts extending from the arms to press the resistor. The press-fit contacts are arranged on different positions displaced in the pair of opposite surfaces of the resistor.

In the present invention, the conductive pinchers are located such that the press-fit contacts do not stand face to face with each other. Accordingly, even if the resistor pinched is broken, any broken fragment is not pinched between the conductive pinchers, resulting in no production of smoke on heating when energized.

DETAILED DESCRIPTION OF THE INVENTION

A starter relay comprises a resistor having a positive resistance temperature coefficient; a pair of conductive pinchers having conduction and resilience and configured to press a pair of opposite surfaces of the resistor and pinch the resistor to establish connection with the resistor; and a container composed of an electrical insulator to house the resistor and the pair of conductive pinchers therein. The conductive pinchers each include a body, two arms extending from both ends of the body, and two spaced press-fit contacts extending from tips of the arms to press the resistor, and are formed by stamping a plate-like member. The spaced press-fit contacts are arranged in crossed directions.

Figure 1:
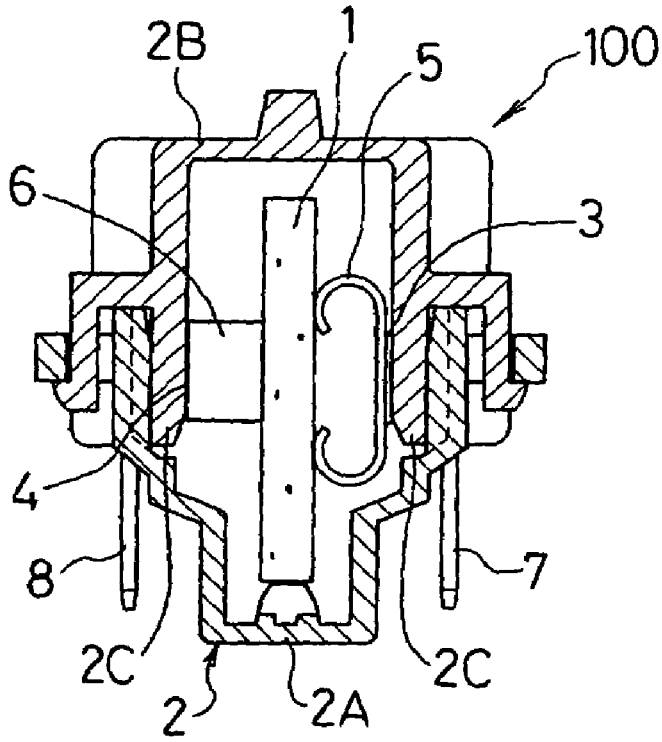
FIG. 1 shows an illustrative view of an embodiment of the present invention.

An embodiment of the present invention will be described below with reference to FIGS. 1 and 2. For ease of understanding, also in these figures, the parts having the similar functions as those once described in the above figures are given the same reference numerals and omitted from the following description without interfering with understanding.

Also in a starter relay 100 of the present invention, a resistor 1 may be made of barium titanate ceramics (Curie point: 130° C.), which has an electrical resistance that sharply increases when heated up to a certain temperature or higher.

The reference numerals 3, 4 denote feeding devices (corresponding to those described as contact devices in Patent Document 2), which include contact springs 5,6 serving as conductive pinchers for the resistor 1, and terminals 7,8 coupled to power lines, not shown. The feeding devices are composed of a metal having conduction and resilience.

The contact springs 5,6 are each formed by stamping a plate-like member, like the C-shaped contact springs used in the starter relay 100Y proposed in the Patent Document 2. Each has a body 5A, 6A formed elongate at the center, two arms 5B1, 5B2, 6B1, 6B2 extending from both end portions of the body in the longitudinal direction, and spaced press-fit contacts 5C1, 5C2, 6C, 6C2 extending from tip portions of the arm for pressing and pinching a pair of opposite surfaces of the resistor 1 from both sides (plane surface contact).

The feeding devices 3, 4 differ from each other in formation of the terminal relative to the contact spring. In the feeding device 3, the contact spring 5 and the terminal 7 are similar to those in the contact device in the Patent Document 2. In a word, the terminal 7 slightly protrudes outward from the side of the body 5A of the contact spring 5 and is formed to have a length exceeding the one arm 5B1 from the center of the body 5A in the longitudinal direction. In the feeding device 4, the terminal 8 protrudes in a lateral direction (downward in the page) orthogonal to the longitudinal direction of the body 6A from the center of the body 6A of the contact spring 6 in the longitudinal direction, and is formed on one side.

Figure 2:
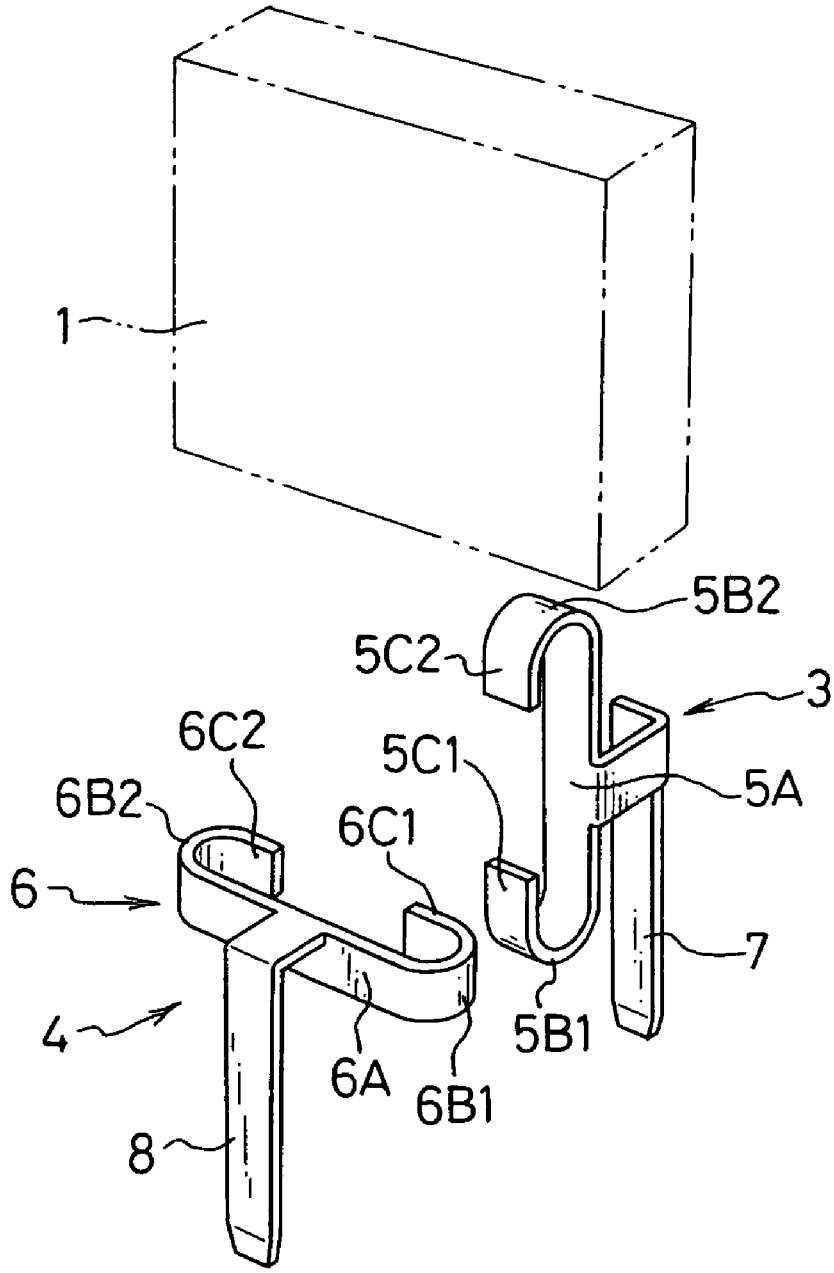
FIG. 2 shows an illustrative view of the major part of the present invention.

As exemplified in FIG. 2, the feeding devices 3, 4 are arranged such that the press-fit contacts 5C1, 5C2 of the contact spring 5 oppose the press-fit contacts 6C1, 6C2 of the contact spring 6 while the terminals 7, 8 become parallel. In this case, the body 5A of the contact spring 5 crosses the body 6A of the contact spring 6. Thus, the press-fit contacts 5C1, 5C2 of the contact spring 5 and the press-fit contacts 6C1, 6C2 of the contact spring 6 have different positions shifted from each other and do not stand face to face with each other.

The feeding devices 3, 4 are housed in the container 2 composed of the electrical insulating hard resin in the direction shown in FIG. 2. The resistor 1 is pressed laterally and pinched between the press-fit contacts 5C1, 5C2 of the feeding device 3 and the press-fit contacts 6C1, 6C2 of the feeding device 4. In this case, even if the resistor 1 is broken due to occurrence of an unexpected accident in use, a broken fragment of the resistor is not press-pinched between the press-fit contacts 5C1, 5C2 of the feeding device 3 and the press-fit contacts 6C1, 6C2 of the feeding device 4. Accordingly, any inconvenience such as production of smoke can be avoided even when power is supplied from the terminals 7, 8. In addition, the press-fit contacts 5C1, 5C2 of the feeding device 3 and the press-fit contacts 6C1, 6C2 of the feeding device 4 can not be brought into contact with each other.

The present invention is not limited to the above embodiment but rather can be modified variously without departing from the scope of the invention as recited in the appended claims.

Figure 3:
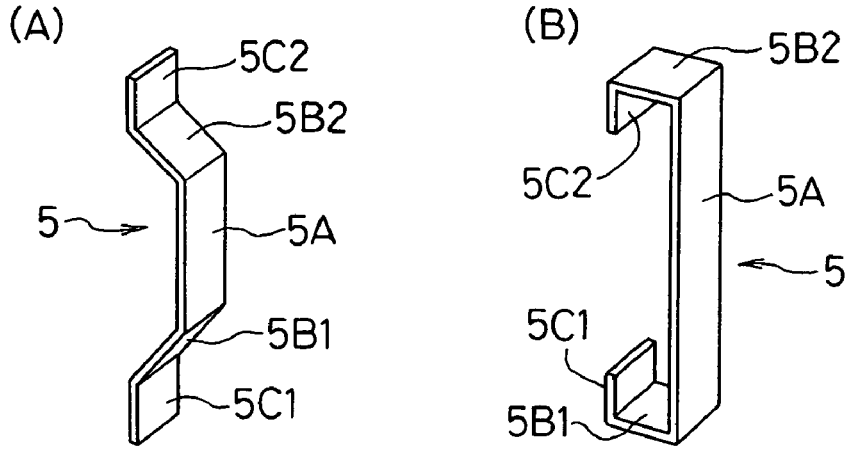
FIG. 3 shows illustrative views of other examples of the shape of the major part of the present invention, in which (A) is an illustrative view of a contact spring 5 formed in a separated V-shape, and (B) is an illustrative view of a contact spring 5 formed in a C-shape.
Figure 4:
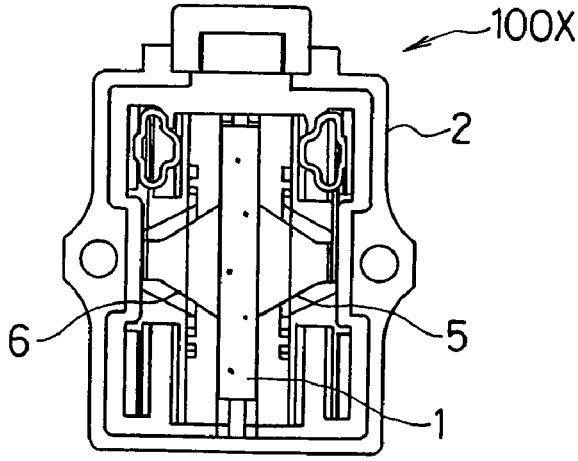
Fig. 4 Prior Art
FIG. 4 shows an illustrative view of a first prior art.
Figure 5:
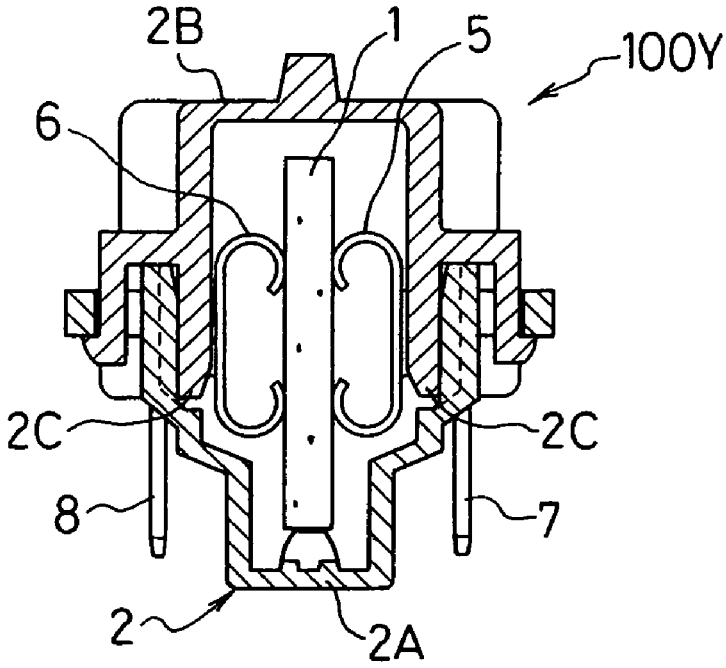
Fig. 5 Prior Art
FIG. 5 shows an illustrative view of a second prior art.

For example, the contact springs 5, 6 serving as the conductive pinchers may be modified in those having the shapes exemplified in FIG. 3. The press-fit contacts for pressing and pinching the resistor 1 from both sides may be provided as dispersed on three or more locations. The press-fit contacts may be provided one by one.

When the conductive pinchers each have a single press-fit contact, the single press-fit contact may be arranged on a location shifted from another in each of a pair of opposite surfaces of the resistor 1. In this case, a rotation moment acts on the resistor 1 from the pair of conductive pinchers pinching the resistor. Accordingly, it is required to provide an appropriate rotation stopper in the container 2 to prevent the resistor 1 from rotating.

The terminals 7, 8 may be formed in the same direction relative to the contact springs 5, 6. As for the feeding devices 3, 4 including the contact springs 5, 6 serving as the conductive pinchers, a positioning means on installation into the container 2 may be added appropriately.

The feeding devices 3, 4 may be formed by stamping a respective single plate-like member. Alternatively, the contact springs 5, 6 formed by stamping a single plate-like member, and the remainder including the terminals 7, 8 and so forth may be integrated by spot welding.

What is claimed is:

1. A starter relay comprising:

a resistor having a positive resistance temperature coefficient;

a pair of conductive pinchers having conduction and resilience and configured to press a pair of opposite surfaces of the resistor and pinch the resistor to establish connection with the resistor; and a container composed of an electrical insulator to house the resistor and the pair of conductive pinchers therein, wherein the conductive pinchers each include a body, two arms extending from both ends of the body, and two spaced press-fit contacts having plane surfaces and extending from tips of the arms to press the resistor in plane contact, wherein the spaced press-fit contacts are arranged in crossed directions and on different positions displaced in the pair of opposite surfaces of the resistor.

2. The starter relay according to claim 1, wherein the conductive pinchers including the body, arms and press-fit contacts are formed by stamping a plate-like member.

* * * * *

UNITED STATES PATENT AND TRADEMARK OFFICE

CERTIFICATE OF CORRECTION

PATENT NO. : 7,522,030 B2
APPLICATION NO. : 11/451863
DATED : April 21, 2009
INVENTOR(S) : Masahide Kobayasi It is certified that error appears in the above-identified patent and that said Letters Patent is hereby corrected as shown below:

Front page, (74) Attorney, Agent or Firm, "Levoici" should read --Lebovici--.

Signed and Sealed this

Third Day of November, 2009

David J. Kappos

David J. Kappos
*Director of the United States Patent and Trademark Office*